United States Patent [19]

Riordan

[11] Patent Number: 5,005,000

[45] Date of Patent: Apr. 2, 1991

[54] KIT CONTAINING COMPONENTS FOR AN ALARM SCREEN ASSEMBLY

[76] Inventor: Dennis E. Riordan, Los Angeles, Calif.

[21] Appl. No.: 941,166

[22] Filed: Dec. 12, 1986

[51] Int. Cl.[5] ..... G08B 13/00

[52] U.S. Cl. ..... 340/550; 160/374

[58] Field of Search ..... 340/550, 545; 160/374, 160/377; 206/407, 389, 223, 225-226

[56] References Cited

U.S. PATENT DOCUMENTS

| | | | |
|---|---|---|---|
| 1,295,476 | 2/1919 | Fry | 160/374 |
| 2,962,187 | 11/1960 | Morris | 206/407 X |
| 3,051,935 | 8/1962 | Willson | 340/550 |
| 4,146,293 | 3/1979 | Mutton et al. | 340/545 X |
| 4,232,310 | 11/1980 | Wilson | 340/550 |
| 4,285,383 | 8/1981 | Steenburgh | 160/374 |

*Primary Examiner*—Glen R. Swann, III
*Assistant Examiner*—Thomas J. Mullen, Jr.
*Attorney, Agent, or Firm*—W. Edward Johansen

[57] ABSTRACT

The present invention is a kit which contains components for an alarm screen assembly. The kit includes a screen mesh which is formed from a sheet of non-conductive screen material and a conductive wire which is mechanically coupled to the screen mesh. The screen mesh has marginal edge portions. The kit also includes a plurality of framing members and frame member-couplers. Each framing member is adapted to secure one of the marginal edge portions of the screen mesh thereto. The framing member-couplers couple the framing members together to form a frame which is to be mounted on a building enclosing structure. The kit further includes a container which includes a tubular member which has a first open end and a second open end. The tubular member is of a predetermined length and a predetermined diameter. The container also includes a first end cap and a second end cap. The first and second end caps are disposed at the first and second open ends of the tubular member, respectively. Each framing member is of either equal length or shorter length than the predetermined length of the tubular member. The screen mesh, the conductive wire, the framing members and the framing member-couplers may be placed in the container. The kit can be conveniently and easily shipped in the container across country to a customer for assembly thereby.

1 Claim, 4 Drawing Sheets

Fig. 7.
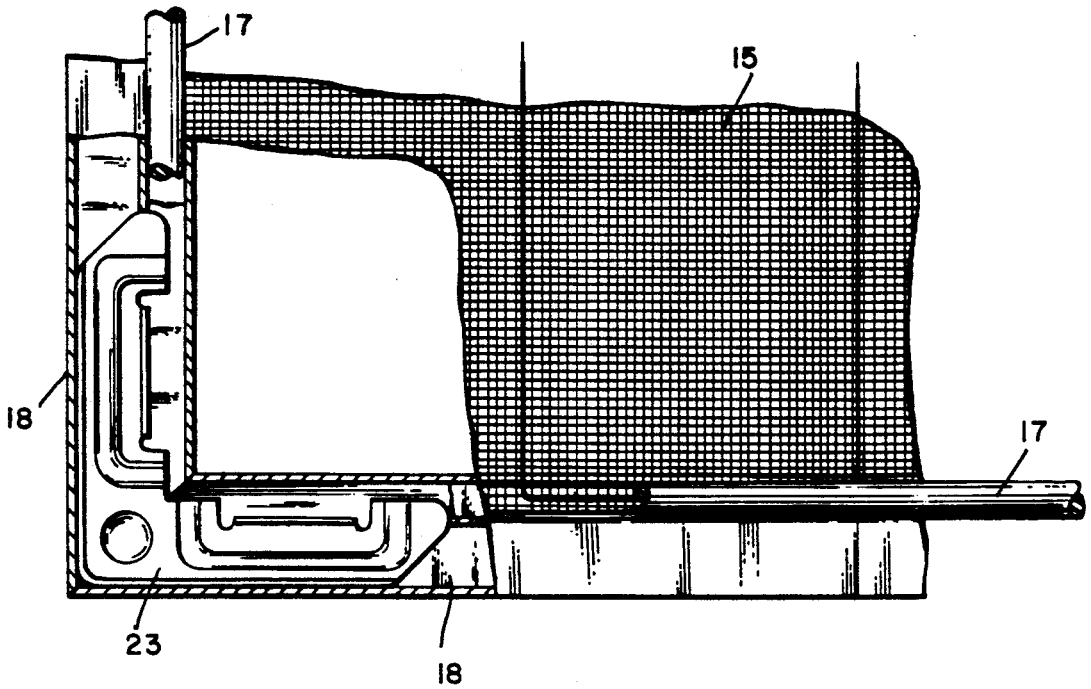
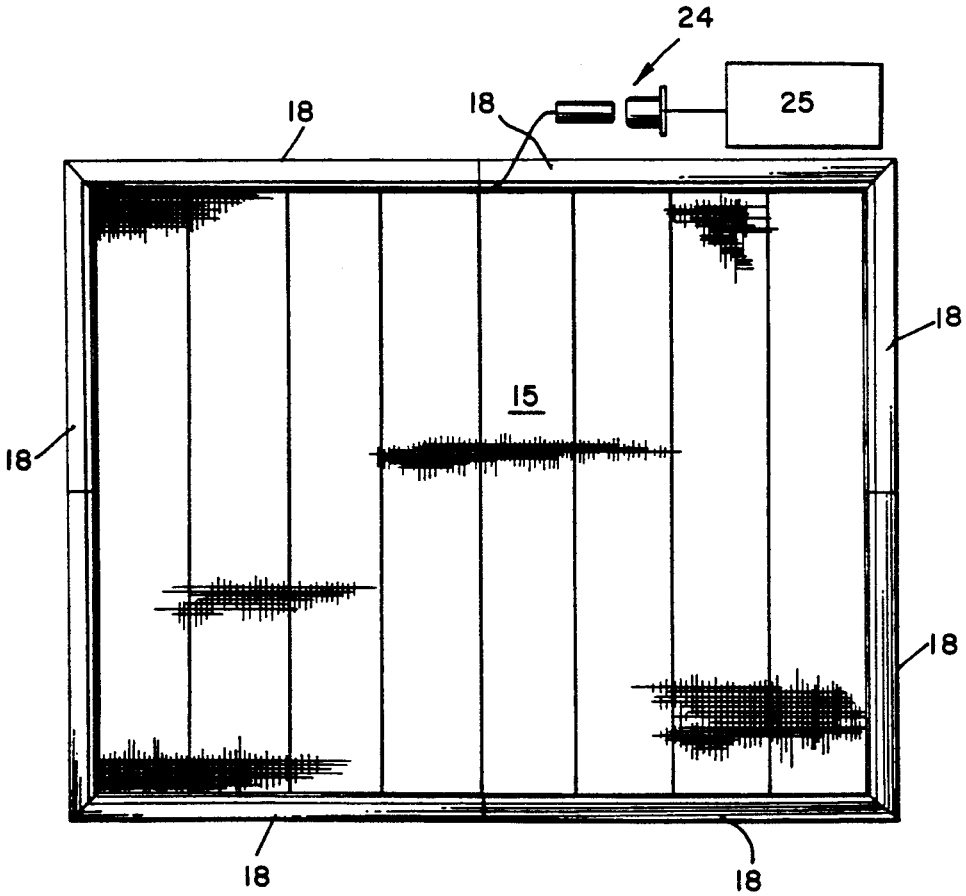
Fig. 8.

KIT CONTAINING COMPONENTS FOR AN ALARM SCREEN ASSEMBLY

BACKGROUND OF THE INVENTION

1. Field of the Inventions

The present invention relates to components for an alarm screen assembly and more particularly components for an alarm screen assembly in a kit which can be conveniently and easily shipped in a tubular container across country.

2. Description of the Prior Art

U.S. Pat. No. 3,051,935, entitled Protective Screen, issued to Clarence P. Willson on Aug. 28, 1962, teaches an alarm screen which includes a frame which is mounted on a building enclosing structure, a screen mesh which is formed from a sheet of non-conductive screen material and which has its marginal portion secured to the frame and at least two strands of conductive wire which are disposed parallel and spaced apart and which are interwoven in the screen mesh with each of the strands having an end portion which terminates adjacent to the frame. It is necessary to mechanically splice together, by either soldering or twisting to each other, the ends of the strands of conductive wire in order to form a continuous wire.

U.S. Pat. No. 4,146,293, entitled Entry Detection Screen, issued to Robert E. Mutton and Dennis E. Riordan on Mar. 27, 1979, teaches an alarm screen which includes a frame and a screen mesh. In one embodiment the alarm screen also includes a single wire which is sewn onto the screen mesh in order to fix it in place and which provide a series circuit. In another embodiment the alarm screen also includes double wires which are sewn onto the screen mesh in order to fix it in place so that two series circuits can be provided. The double wires can be twisted to make the alarm circuit more difficult for an intruder to defeat. A twist of the double wires can be made under a section of frame where the twist cannot be seen by an intruder. In both embodiments the single wire and the double wires are continuous. Unlike the alarm screen of U.S. Pat. No. 3,051,935 mechanical splicing of conductive wires is not necessary.

U.S. Pat. No. 4,334,573, entitled Pet Access Door Kit and Method of Installation, issued to James M. Hackman and La Vona Hackman on June 15, 1982, teaches a pet access door kit and a method of installation in a screen door. The pet door access kit includes members attachable to the door screen to define a generally rectangular screen section adjacent a lower corner of the screen door. The screen material is cut within the defined area except for the upper extremity of the section to form a screen flap. The upper extremity of the flap constitutes a hinge portion. A suitable weight is attachable to the lower extremity of the flap in order to maintain it in a closed position.

U.S. Pat. No. 4,461,384, entitled Card Frames, issued to David P. Erlam on July 24, 1984, teaches a packaged card frame kit which includes a pair of side plates and a plurality of cross rails and a box. The cross rails can be assembled together with the side plates forming at least part of the card frame. The box is capable of housing the side plates and cross rails so that the box can transport the side plates and cross rails. Each side plates includes a main body portion. Each cross rail is adapted to be secured to the main body portions of the side plates when the side plates are in a predetermined upright orientation. The main body portions are spaced apart by a predetermined distance. The box includes a support member which supports the side plates with the main body portions in a laid flat condition during transport. The support member also includes a pair of first receptors which are spaced apart by the same predetermined distance and which are adapted to engage portions of the side plates and to support the side plates in the predetermined upright orientation with the main body portions which spaced apart by the predetermined distance The support member further includes a second receptor which is associatred with each of the first receptors. Each second receptor is adapted to engage the end portions of the cross rails and maintain the cross rails in a predetermined orientation in which the cross rails extend between the first receptors during transport. The second receptors allow movement of the cross rails between the side plates when the the side plates are in the predetermined upright orientations in order to allow attachment of the cross rails to the side plates while the side plates are in the upright orientation.

U.S. Pat. No. 4,380,290, entitled Shipping and Storage Container, issued to Randall A. Luebke on Apr. 19, 1983, teaches a container for shipping and storing elongated articles. The container includes a tubular housing having oppositely disposed open ends and a pair of end cap members which are adapted to be removably mounted to the tubular housing.

U.S. Pat. No. 4,546,880, entitled Shippable Package of Glass Fiber Strands and Process for Making the Package and Continuous Strand Mat, issued to Walter J. Reese on Oct. 15, 1985, teaches a shippable, covered cylindrcial package of one or more sized glass fiber strands which provides wet, continuous glass fiber strand with improved payout from the cylindrical package.

U.S. Pat. No. 4,385,697, entitled Shipping Package for Crutches, issued to Ted F. Urban on May 31, 1983, teaches a shipping package for crutches which includes a pair of crutches disposed in face-to-face alignment. Each crutch has a pair of side members and an arm piece which connects the uper ends of the side members. Each crutch also has a hand grip which connects the central portions of the side members. The arm piece, the side members, and the hand grip of each crutch defining an opening. The openings are disposed in alignment. A container is disposed with the hand grips and extends laterally between the side members. A plurality of rubber-like acessories are disposed within the container. A heat shrunk plastic covering encloses the crutches and the accessories.

U.S. Pat. No. 4,275,970, entitled Plant Care Kit, issued to Howard J. Morrison on June 30, 1981, teaches a plant care kit which includes a generally planar support member, a first cleaning element and a handle. The support member gently supports a leaf of a plant or the like. The first cleaning element is mounted on the top surface of the support member and engages the underside of the leaf. The handle is mounted on the bottom surface of the support member and provides limited oscillation about an axis generally parallel to the bottom surface. The handle includes a mechanism for captured interdigitated engagement of the fingers of a user. The plant care kit also includes a manually operable second cleaning element and a reservoir. The manually operable second cleaning element engages the top of the leaf and the reservoir contains a predetermined amount of cleaning fluid to be applied to the leaves by the first and second cleaning elements.

SUMMARY OF THE INVENTION

In view of the foregoing factors and conditions characteristic of the prior art it is the primary object of the present invention to provide to a kit in which components for an alarm screen assembly can be conveniently and easily shipped in a tubular container across country.

In accordance with an embodiment of the present invention a kit which contains components for an alarm screen assembly is described. The kit includes a screen mesh which is formed from a sheet of non-conductive screen material and a conductive wire which is mechanically coupled to the screen mesh. The screen mesh has marginal edge portions. The kit also includes a plurality of framing members and frame member-couplers. Each framing member is adapted to secure one of the marginal edge portions of the screen mesh thereto. The framing member-couplers couple the framing members together to form a frame which is to be mounted on a building enclosing structure. The kit further includes a container which includes a tubular member which has a first open end and a second open end. The tubular member is of a predetermined length and a predetermined diameter. The container also includes a first end cap and a second end cap. The first and second end caps are disposed at the first and second open ends of the tubular member, respectively. Each framing member is of either equal length or shorter length than the predetermined length of the tubular member. The screen mesh, the conductive wire, the framing members and the framing member-couplers may be placed in the container. The kit can be conveniently and easily shipped in the container across country to a customer for assembly thereby.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 7 is a partial, enlarge front elevation of an alarm screen assembly as it is being put together with the components from the kit of FIG. 1.

FIG. 8 is a front elevation of the alarm screen assembly including an alarm device which has been put together from the kit of FIG. 1.

DESCRIPTION OF THE PREFERRED EMBODIMENT

Figure 1:
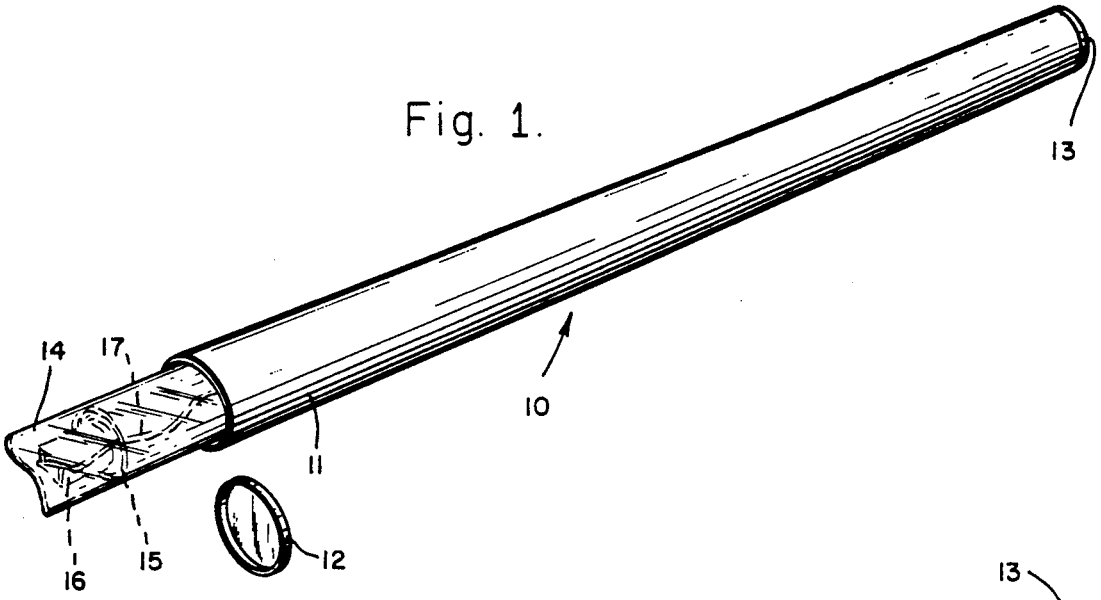
FIG. 1 is a perspective drawing of a tubular container for a kit which includes components for an alarm screen assembly and which has been constructed in accordance with the principles of the present invention.
Figure 2:
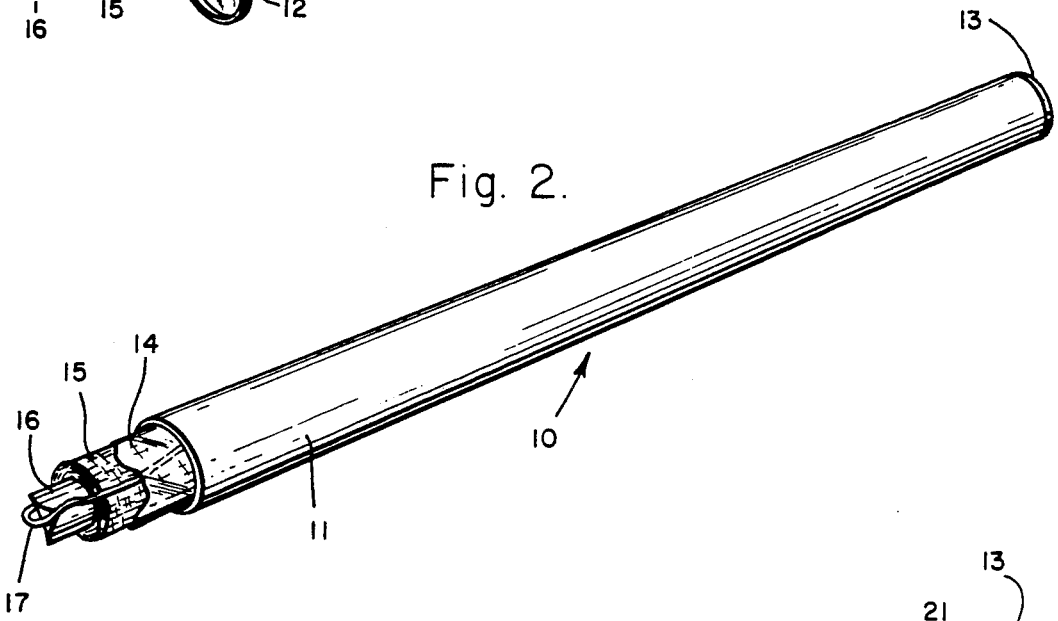
FIG. 2 is a perspective drawing of the tubular container of the kit of FIG. 1 with a first plastic package being shown after it has been opened.
Figure 3:
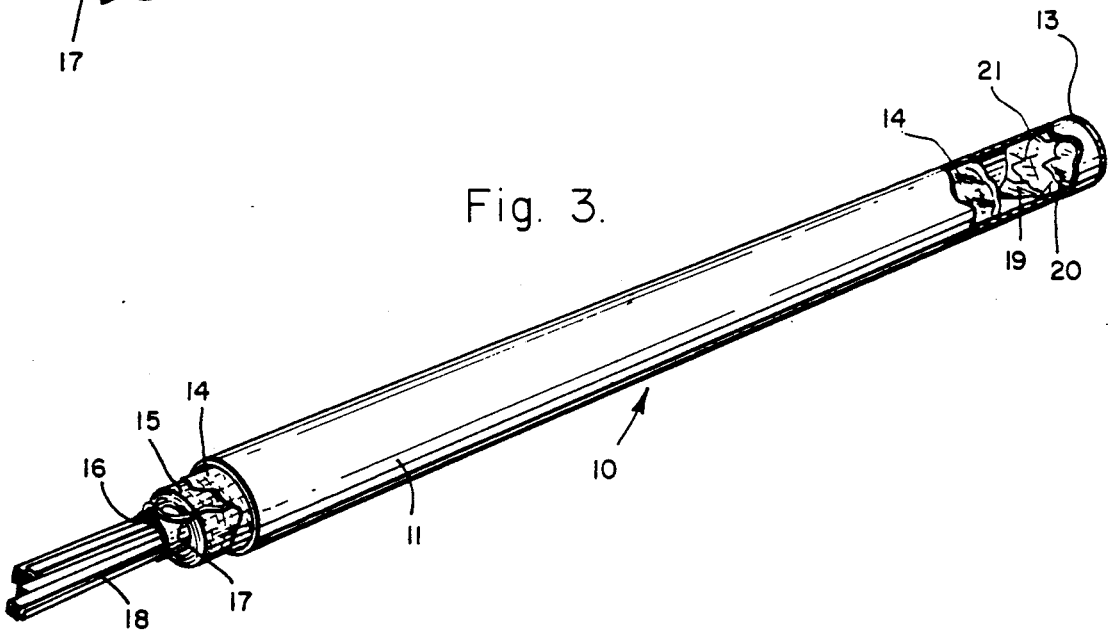
FIG. 3 is a perspective drawing of the tubular container of the kit of FIG. 1 with a plurality of framing members being shown pulled out of the tubular container and in partial cross-section showing a second plastic package, a third plastic package and a fourth plastic package all of which contain components which are necessary for putting together the alarm screen assembly.

In order to best understand the present invention it is necessary to refer to the following description of its preferred embodiment in conjunction with the accompanying drawing. Referring to FIG. 1 in conjunction with FIG. 2 and FIG. 3 a kit 10 which contains components for an alarm screen assembly. The kit 10 includes a container 11 which is a first tubular member 11 which has a first open end and a second open end. The tubular member 11 is of a predetermined length and a predetermined diameter. The container 11 also includes a first end cap 12 and a second end cap 13. The first and second end caps 12 and 13 are disposed at the first and second open ends of the container 11, respectively. The kit 10 includes a first plastic 14 and an alarm screen mesh 15 which is disposed inside the first plastic package 14. The alarm screen mesh 15 is formed from a sheet of either non-conductive screen material, such as fiberglass or conductive screen material, such as aluminum or steel wire. The alarm screen mesh 15 has a conductive wire which is mechanically coupled to the screen material so long as it is properly insulated from, if necessary, from the screen material. The alarm screen mesh 15 has marginal edge portions. The kit 10 also includes a second tublar member 16 which has the alarm screen mesh 15 wrapped around it along with pieces of splining material 17 and a plurality of framing members 18.

Figure 6:
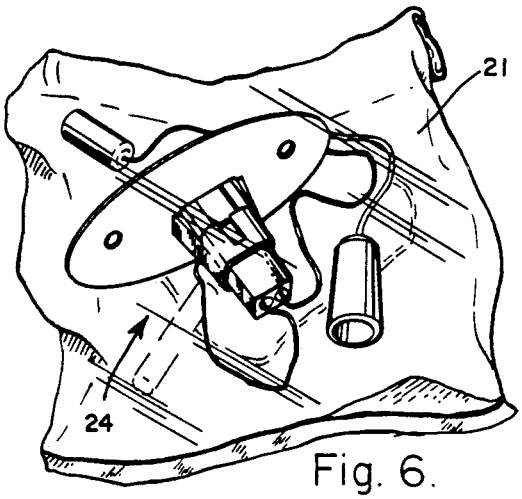
FIG. 6 is a perspective drawing of the fourth plastic package in the kit of FIG. 1 which contains connector-components for connecting the alarm screen assembly to an alarm device.
Figure 4:
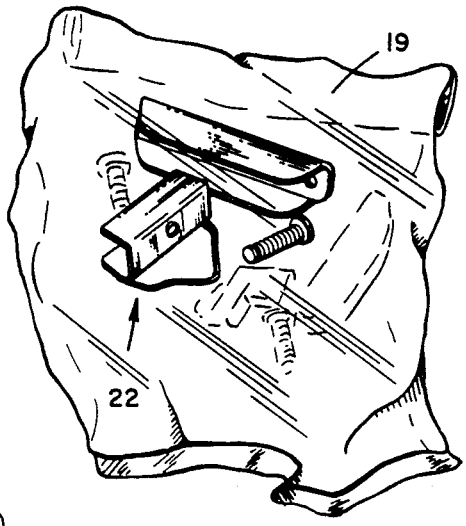
FIG. 4 is a perspective drawing of the second plastic package in the kit of FIG. 1 which contains components for hanging the alarm screen assembly.
Figure 5:
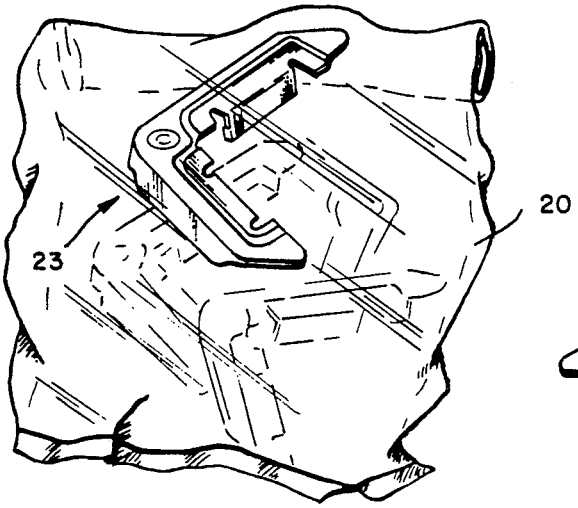
FIG. 5 is a perspective drawing of the third plastic package in the kit of FIG. 1 which contains a plurality of right-angle framing member-couplers for mechanically coupling the framing members together.

Referring to FIG. 4 in conjunction with FIG. 5 and FIG. 6 the kit 10 further includes a second plastic package 19, a third plastic package 20 and a fourth plastic package 21. The second package 19 contains hardware 22 for hanging the assembled alarm screen. The third package 20 contains a plurality of frame member-couplers 23. Each framing member 18 is adapted to secure one of the marginal edge portions of the alarm screen mesh 15 thereto. The framing member-couplers 23 couple the framing members 18 together to form a frame which is to be mounted on a building enclosing structure. Each framing member 18 is of either equal length or shorter length than the predetermined length of the container 11. The alarm screen mesh 15, the framing members 18 and the framing member-couplers 23 may be placed in the container 11 so that the kit 10 can be conveniently and easily shipped in the container across country to a customer for assembly thereby. Each framing member-coupler 23 provides a right-angle joining of two framing members 18. The fourth package 21 contains connector-components 24 for connecting an assembled alarm screen to an alarm device 25.

Referring to FIG. 7 the kit 10 may include a plurality of hand-tools, such as a cutting instrument and a roller-blade for use in installing the pieces of splining material 17, and supplies, such as either a tube of glue and a tube of rubber cement. The framing members 18 are joined together by the framing member-couplers 23. The marginal edges of the alarm screen mesh 15 is inserted into channel in the framing member 18 and secured therein by the pieces of splining material 17.

Figure 9:
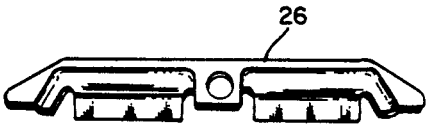
FIG. 9 is a front elevation of a straight frame-couplers for mechanically coupling the framing members together.
Figure 10:
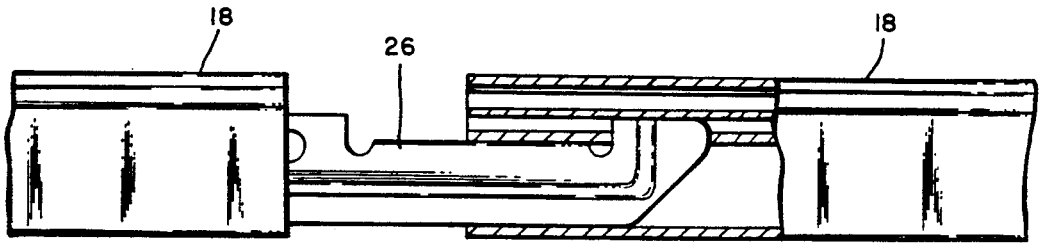
FIG. 10 is a front elevation of a straight frame couplers for mechanically coupling the frame members together.

Referring to FIG. 8 in conjunction with FIG. 9 and FIG. 10 an assembled alarm screen is electrically coupled to an alarm device 25. Each side of the alarm screen is formed by two framing members 18 which are joined together by a framing member-coupler 26 which is straight thereby allowing an alarm screen to be built which may be twice or more times as wide and twice or more times as long as the container 11.

There there are several embodiments of the alarm screen mesh 15. One type of the alarm screen mesh 15 which U.S. Pat. No. 4,146,293 teaches includes a screen mesh with a first continuous strand of conductive wire which is mechanically coupled to the screen mesh. Among the variety of methods of mechanically coupling onto the screen mesh the first continuous strand of conductive wire are sewing and gluing. This type of alarm screen mesh may also include a second continuous strand of conductive wire which is also mechanically coupled to the screen mesh in order to increase security. The first and second continuous strands of conductive wire may be twisted together in order to further increase security.

Figure 11:
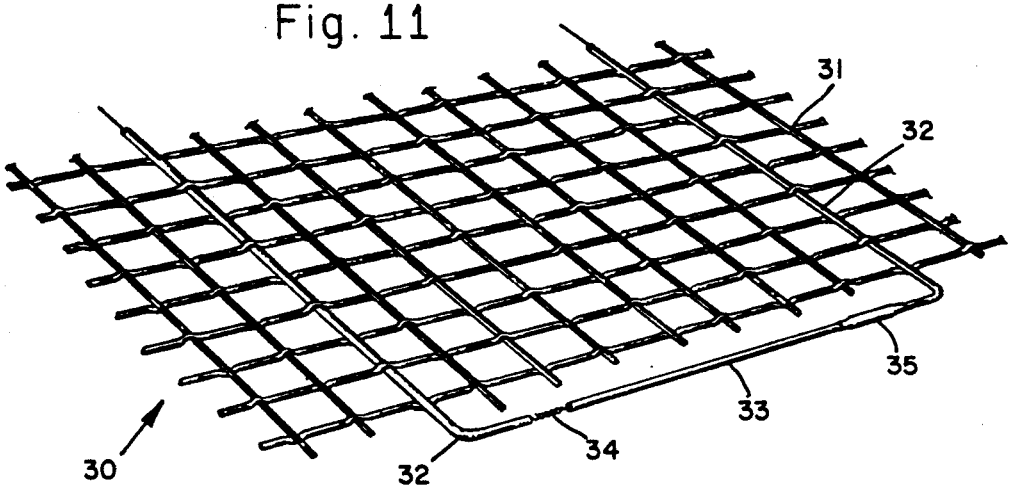
FIG. 11 is a perpective drawing of an alarm screen mesh with a spliced conductive wire which is interwoven into the alarm screen mesh.

Referring to FIG. 11 another type 30 of the alarm screen mesh 15 which U.S. Pat. No. 3,051,935 teaches includes a screen mesh 31 with a first plurality of parallel segments 32 of conductive wire which are interwoven into the screen mesh 31. A segment 33 of conductive wire splices each pair of adjacent parallel segments 32 of conductive wire in series at the peripheral edge of the screen mesh 31 in order to form a length of electrically conductive, continuous wire. The splice 34 is enclosed by a heat shrunk plastic covering 35. The advantage of this type of alarm screen mesh 15 is that it is easy to mass-produce in that each segment 32 of conductive wire is interwoven into the screen mesh 31 as the screen mesh 31 is being woven. The problem with this type of alarm screen mesh 15 is that the splices 34 which connect adjacent pairs of the parallel segments 32 of conductive wire to the connecting segments 33 of conductive wire cause either false alarms or alarm failures. The type of alarm screen mesh 15 which U.S. Pat. No. 4,146,293 teaches a continuous strand of conductive wire which solves the problem of either false alarms or alarm failures, but it is more difficult to mass-produce.

Figure 12:
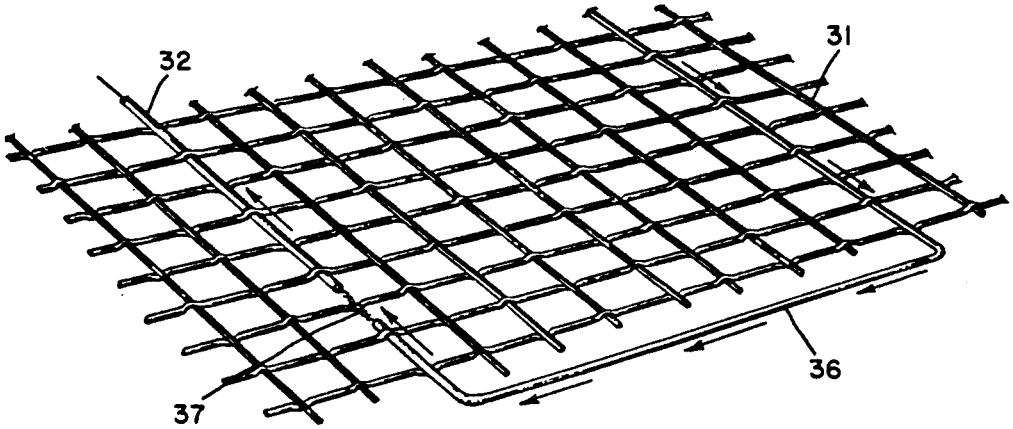
FIG. 12 is a perpective drawing of the alarm screen mesh of FIG. 11 with one end of the spliced conductive wire being mechanically coupled to an end of a continuous f conductive wire so that the spliced conductive wire pulls the continuous conductive wire through the weave of the alarm screen mesh.

Referring to FIG. 12 the spliced segments 32 and 33 of the alarm screen mesh of U.S. Pat. No. 3,051,935 are spliced to a continuous strand 36 of conductive wire and pull it through the weave in the screen mesh 31 in order to achieve the advantages of both types of alarm screen mesh 15. The spliced segments 32 and 33 are mechanically coupled to the continuous strand 36 of conductive wire by a splice 37.

Figure 13:
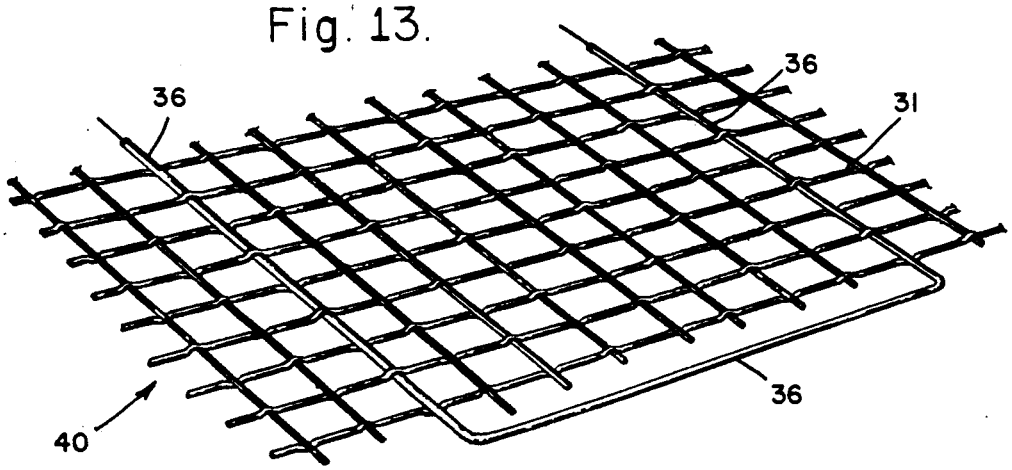
FIG. 13 is a perpective drawing of the alarm screen mesh of FIG. 11 with a continuous conductive wire which is interwoven into the alarm screen mesh.

Referring to FIG. 13 after the spliced segments 32 and 33 pull the continuous strand 36 of conductive wire through the screen mesh 31 there is formed a new alarm screen mesh 40.

From the foregoing it can be seen that a kit containing components for an alarm screen assembly has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. A process for making an alarm screen mesh comprising the steps of:

a. weaving a screen mesh with a plurality of parallel strands of conductive wire so that each of said plurality of strands of conductive wire is interwoven into said screen mesh with each of said plurality of strands of conductive wire having a first end and a second end;

b. cutting a rectangular sheet from said screen mesh and trimming opposite sides of said rectangular sheet in order to leave projecting lengths of each of said plurality of parallel strands of conductive wire into said rectangular sheet;

c. mechanically coupling alternating pairs of said first ends and second ends of said plurality of strands of conductive wire to adjacent strands of conductive wire in order to form a mechanically-coupled plurality of strands of conductive wire to form a sinuous path in said rectangular sheet;

d. mechanically coupling one end of a continuous strand of conductive wire to one end of said mechanically-coupled plurality of strands of conductive wire; and e. using said mechanically-coupled plurality of strands of conductive wire to pull said continuous strand of conductive wire through said rectangular sheet whereby said continuous strand of conductive wire is interwoven into said screen mesh along said sinuous path of said rectangular sheet.

* * * * *